United States Patent [19]

Jaspers

[11] 3,937,030

[45] Feb. 10, 1976

[54] METHOD AND DEVICE FOR GAS REFRIGERATION

[76] Inventor: Hendrik Alphons Jaspers, 9 Liberty St., Ossining, N.Y. 10562

[22] Filed: June 19, 1974

[21] Appl. No.: 480,906

[52] U.S. Cl. ..... 62/86; 62/87; 62/401; 62/403

[51] Int. Cl.[2] ..... F25B 9/00

[58] Field of Search ..... 62/403, 86, 87, 88, 401

[56] References Cited

UNITED STATES PATENTS 2,044,330 6/1936 Richter ..... 62/88

2,903,862 9/1959 Bouchard ..... 62/403

*Primary Examiner*—William J. Wye

*Attorney, Agent, or Firm*—John J. Byrne; Edward E. Dyson

[57] ABSTRACT

An open-cycle air-conditioner for compressing and expanding gas with heat rejection for cold production and more particularly to improved means for carrying out thermodynamic cycles in open cycle systems using an internal, stationary, porous body as a thermal capacitor.

10 Claims, 6 Drawing Figures

METHOD AND DEVICE FOR GAS REFRIGERATION

In conventional air conditioning systems freon is often used as a working medium. The principle components of such systems include a freon compressor, a low temperature heat exchanger, a high temperature heat exchanger, an expansion valve and one or two blowers to force air through the heat exchangers. The low temperature heat exchanger is generally not allowed to drop in temperature below 273°K, to avoid freezing of condensed water and to avoid poor conversion efficiencies. These systems, i.e., those using an intermediate working medium such as freon, are oftentimes referred to as "closed" systems. Thermodynamic refrigerating cycles involve a compression and an expansion of the working fluid and temperatures below ambient are achieved by the, preferably adiabatic, expansion of a compressed fluid. If air is to be cooled it is forced past the working medium as the working medium is expanded and taking heat.

When the air to be cooled is also the working fluid, the system is "open cycle". The prior art has found many difficulties with open cycle systems for which it is a primary objective of this invention to solve.

In conventional open cycle systems fresh ambient air is compressed and the heat of compression is removed by recuperative heat exchangers. This is followed by expansion and lower temperatures. Typical problems relate to achieving system efficiency and to obtain the small volumes and weights common to freon and other closed systems. A principle objective of this invention is to provide means for overcoming many of these difficulties by utilizing an internal stationary thermal capacitor in an open cycle air conditioning system.

The prior art is aware of the use of regenerators with closed systems. However, in these systems the regenerators are normally used with balanced (equal flow in both directions) flow conditions if efficient operation is to obtained. In the instant invention balanced flow conditions are achieved by valve control so that a fixed amount of fresh air automatically and alternately removes the heat of compression and the produced cold, stored in the thermal capacitor. The valving is operated at a frequency of one-half of the alternating volume frequency.

Although the thermal capacitor of the invention is small, it nevertheless offers increased heat transfer at small temperature differences. Another objective of the invention is to provide a compact, open air conditioning system offering high efficiency. A still further objective of this invention is to provide an open cycle air conditioning system having reduced system pressure. Because of the temperature gradient in its thermal capacitor, the working fluid pressure is not required to exceed approximately 15 psi. gauge pressure. Open systems of the prior art oftentimes require at least 40 psi. to reach adequate cooling temperatures.

The above mentioned and other features and many attendant advantages of this invention will be readily appreciated upon consideration of the following detailed description of a presently preferred design, and the accompany drawings wherein.

Figure 1:
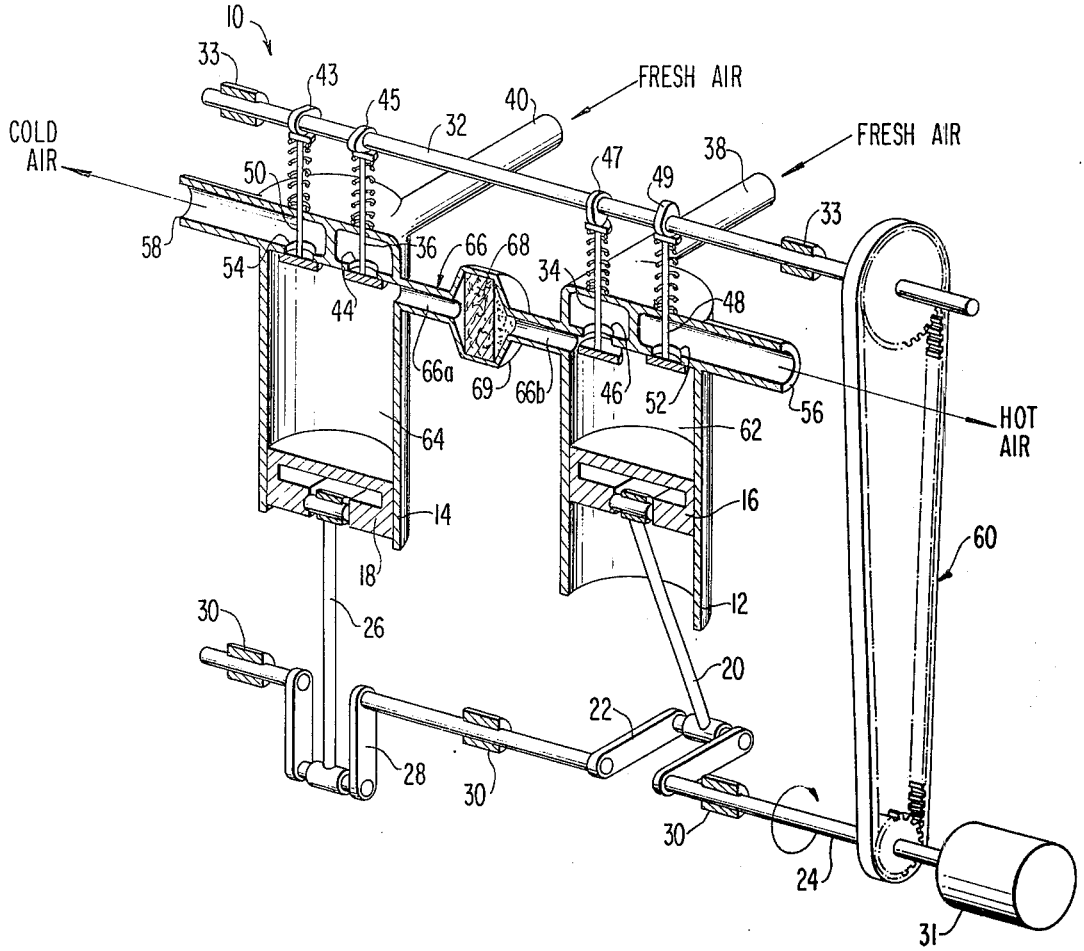
FIG. 1 is a diagrammatic cutaway perspective view showing operation of the system.

Referring now to the drawings wherein like elements are referred to by numerals, the mechanism of this invention is referred to generally by the numeral 10. A first cylinder 12 and a second cylinder 14 slidably and respectively receive pistons 16 and 18. Piston 16 is actuated by means of connecting rod 20 driven by offset portion 22 of rotating crankshaft 24. The crankshaft is mounted in bearings 30 and is rotated by any conventional power means 31. Piston 18 is actuated by means of connecting rod 26 driven by offset portion 28 of the crankshaft 24.

A first varying volume compression space 62 is achieved in the space formed by cylinder 12 and reciprocating piston 16. A second varying volume expansion space 64 is similarly achieved in the space formed by cylinder 14 and piston 18. The compression space 62 is communicated with an expansion space 64 by a duct 66. A thermal capacitor 68 is located intermediate the length of duct 66. The thermal capacitor is of a type offering little restriction to the passage of a gas therethrough. The thermal capacitor 68 can be constructed of multi-layer wire mesh or a relatively dense steel wool. Because of moisture and condensation conditions, the substance of which the capacitor is made should be of a non-rust variety.

The capacitor is received in a housing portion 69. The duct segments on either side of the housing will be referred to by the numerals 66*a* and 66*b*.

Compression space 62 is communicated with a fresh air duct 38 through an inlet valve 34 which is operable to open and close a port 46. The space 62 is also cummunicated to hot air exhaust duct 56 through a port 52 which is adapted to be opened and closed by an outlet valve 48. Expansion space 64 is communicated to ambient air by duct 40 and port 44. The port 44 is adapted to be opened and closed by valve 36. Space 64 is communicated to a cold air duct 58 by outlet 54 under the control of a valve 50.

The valves 50, 36, 42 and 48 are operated respectively by cams 43, 45, 47 and 49 mounted on camshaft 32. The shaft 32 is supported in bearings 33. The camshaft is driven by crankshaft 24 by means of a non-slip belt and gear arrangement 60 having intermeshing teeth. The transmission 60 has a speed reduction ratio of "2:1" to insure proper timing. The cams, of course, are shaped and affixed to the cam shaft to provide for opening and closing of the valves described herein.

Two crankshaft revolutions will complete a single cycle. Pistons 16 and 18 are out of phase by a rotational angle corresponding to the angular displacement of crank offset 22 with respect to crank offset 28 of crankshaft 24. The phase ange may have any value between 0° and 180° although the most economical values will be found between 90° and 120°. As shown in FIG. 1, the offset is 90°.

The following explanation of operation, the working medium, being air, will be considered as an ideal gas. This is a close approximation for low pressure air at a temperature above 270°K. For ideal gases $p\ V = m\ R\ T$, where $p$ is the pressure, $V$ the volume, $m$ the total mass of gas, $R$ the gas constant and $T$ the absolute temperature of the gas. In other words the pressure times the volume of a certain amount of gas is equal to its total mass m multiplied by a gas constant $R$ and its absolute temperature $T$.

For a closed system comprising a number of interconnected volumes each with a different temperature this leads to the following relationship:

$$p * \left(\frac{V_1}{T_1} + \frac{V_2}{T_2} + \frac{V_3}{T_3} + \ldots\right) = (m_1 + m_2 + m_3 + \ldots) * R = \text{constant (Eq. No. 1)}$$

If each partial system volume $V_x$ is reduced by multiplying the volume value by the temperature factor $T_a/I_x$, in which $T_x$ is the mean volume temperature and $T_a$ is the ambient air temperature taken as a reference. It may be stated that the gas pressure in the system multiplied by the sum of all reduced volumes is constant, thus:

$$p * \left(V_1 * \frac{T_a}{T_1} + V_2 * \frac{T_a}{T_2} + V_3 * \frac{T_a}{T_3} + \ldots\right) = \text{constant (eq. No. 2)}$$

Figure 2A:
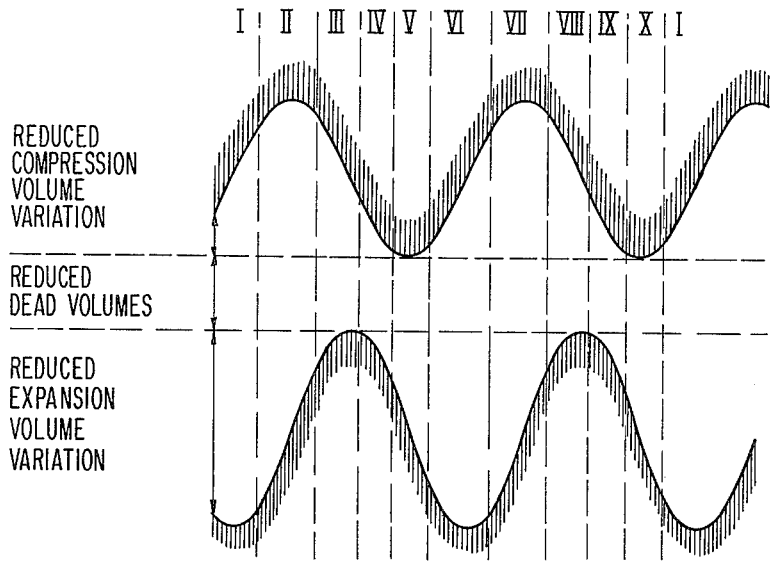
FIGS. 2A, 2B and 2C are graphical representations of volume and pressure variations plotted against crankshaft positions.
Figure 2B:
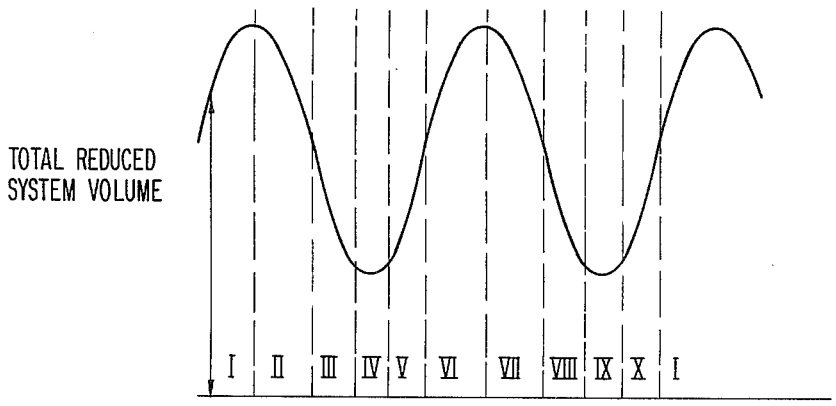
Figure 2C:
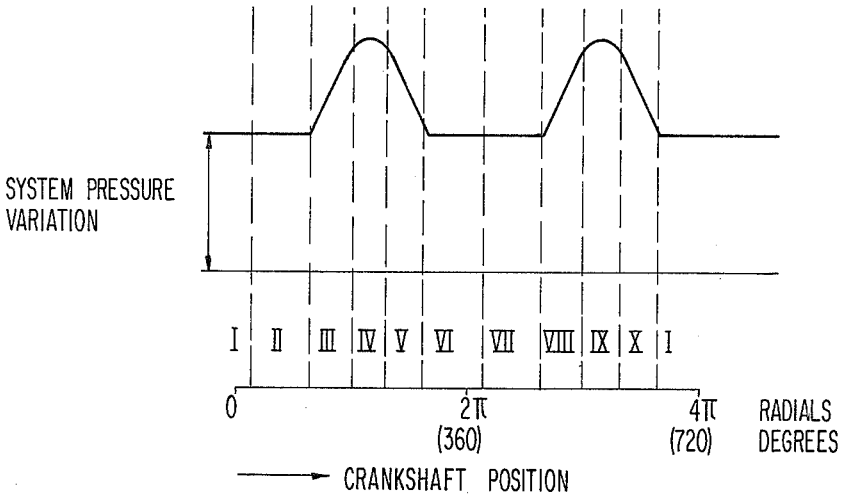

FIG. 2*a* illustrates the variation of the reduced system volumes with crankshaft position for a system in which the phase difference in volume variation is 90°. FIG. 2*c* illustrates the variation of the sum of all reduced system volumes with crankshaft position. The crankshaft position is defined as 0° when the expansion space volume 64 reaches its maximum value and the compression space inlet valve 34 is opened. For purposes of description, as seen in FIG. 2, each cycle period of two crankshaft revolutions is divided into the ten intervals I through X.

During interval I, only the compression space inlet valve 34 is opened and fresh air is drawn into the compression space 62 at atmospheric pressure during the time interval that total reduced system volume increases.

During the time period of interval II, only the expansion exhaust valve 50 is open and air at low expansion space temperature is released at an atmospheric pressure level, while total reduced system volume decreases.

During intervals III, IV and V, all valves are closed and equation No. 2 is applicable. The system pressure will rise and fall inversely proportional to the total reduced system volume as shown in FIG. 2*c*.

During interval III air is compressed in the compression space 62. During interval IV, hot air is transferred via duct 66 *b*, from the compression space to the expansion space 64, passing through the thermal capacitor 68 in which much of the heat of compression is stored temporarily. During interval V, the already relatively cool air expands in space 64 resulting in lower temperatures. During interval VI the expansion space inlet valve 36 is open and fresh air is drawn to space 64 and it is largely transferred to the compression space 62 through the thermal capacitor 68, thus passing and removing the compression heat that was temporarily stored. During interval VII, the compression space exhaust valve 48 is open and air at high compression space temperature is exhausted. During intervals VIII, IX, and X all valves are closed and a compression, a transfer and an expansion take place as in intervals III, IV and V.

Since most of the expansion work occurs in expansion space 64 and most of the compression work occurs in the compression space 62, the mean expansion space temperature will be lower and the mean compression space temperature will be higher than the temperature of fresh air entering the system.

Figure 3:
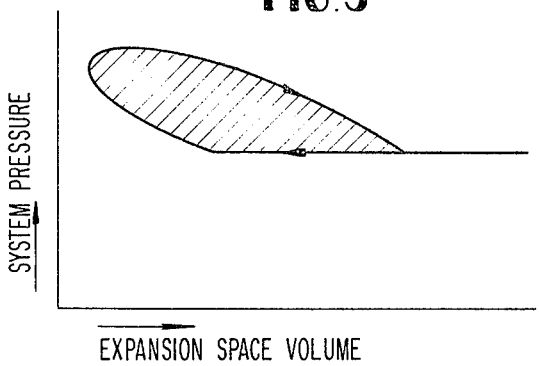
FIG. 3 is an idealized pressure-volume diagram for the expansion space.
Figure 4:
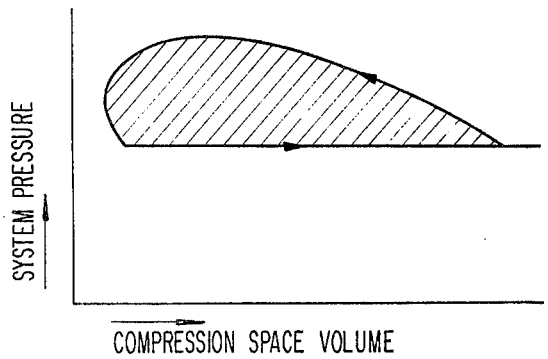
FIG. 4 is an idealized pressure-volume diagram for the compression space.

When the system pressure of FIG. 2*c* is plotted versus the expansion space volume variation and versus the compression space volume variation, the results obtained are as diagrammatically shown in FIGS. 3 and 4.

During each cycle, these diagrams are traversed twice. The enclosed area of FIG. 3 represents the expansion work performed by piston 18 or represents the heat removed during one cycle. If there were no conduction losses and regenerative losses in the thermal capacitor, the expansion work performed would show completely as a temperature drop between inlet air and the outlet air at the expansion space. In case of humid air, however, a part of this indicated cold production is lost as water condenses and releases heat at the expansion side of the thermal capacitor. Consequently, that much less heat is removed from the air to be cooled.

The enclosed area of FIG. 4 represents the compression work performed by piston 16 during a single cycle. If there were no conduction losses and regenerative losses in the thermal capacitor, this work would show completely as a temperature increase between the inlet air and the outlet air from the compression space.

Without any irreversibility during each cycle, the system efficiency would be equal to the well known Carnot efficiency determent by the expansion and compression space temperatures.

Since an unbalanced flow condition through the thermal capacitor would cause many serious irreversibilities, the high efficient ideal situation is more closely approached with the steady balanced conditions achieved in this invention by valve timing related to the system volume variation, rather than by pressure differences and flow restrictions.

If, by reducing the actuation time of the valves, a longer time interval is chosen for the valves to be closed, cold production will increase and the discharge air flow will decrease. This results in a larger temperature difference between inlet and outlet air. A large cold production per unit of swept volume requires small air flows and a large temperature difference between inlet and outlet. However, this is limited, by the fact that the discharge air temperature should not be permitted to drop below the freezing point of water.

Systems made in accordance with the teachings of this system will show temperature differences of 15° to 25° Kelvin, still with a favorable specific cold production; the time, during which all valves are closed, will in that case be near to one-half of the cycle time.

In a general manner, while there has been disclosed an effective and efficient embodiment of the invention, it should be well understood that the invention is not limited to such an embodiment as there might be changes made in the arrangement, disposition, and form of the parts without departing from the principle of the present invention as comprehended within the scope of the accompanying claims.

I claim:

1. An open cycle system for taking ambient air and removing heat from one portion thereof and adding said heat to the remaining portion thereof to thus obtain an output of relatively cool air and an output of relatively hot air comprising:

a first cylinder, a first piston, reciprocally received in said first cylinder and forming a first variable volume chamber therewith, a second cylinder, a second piston reciprocally received in said second cylinder and forming a second variable chamber therewith, a first duct communicating said first and second chambers, a heat capacitor means disposed intermediate the length of said duct, power means to reciprocate said pistons in an out-of-phase relationship with respect to one another, a first air intake duct communicated with said first chamber via a first valve seat opening, a second air intake duct communicated with said second chamber via a second valve seat opening, a hot air exit duct communicated with said first chamber via a third valve seat opening, a cold air exit duct communicated with said second chamber via a fourth valve seat opening, first, second, third and fourth valves, respectively, opening and closing said first, second, third and fourth valve seat opening, timing means sequentially opening and closing said valves to cause air compressed and heated in said first chamber to pass through said capacitor, where a portion of the heat is stored, and then into an expanding second chamber and to exhaust this relatively cooler air to said cold air exit duct, and said timing means sequentially opening and closing said valves to cause fresh air to mix with said relatively cooler and expanded air in said second chamber and to pass through said capacitor in the direction toward said first chamber and removing the compression heat stored therein and then into said first chamber and to exhaust whereby the relatively hot air is exited through said hot air exit duct.

2. The system defined in claim 1 wherein the matrix of said thermal capacitor is a multiple layer of wire mesh.

3. The system defined in claim 1 wherein said thermal capacitor is steel wool.

4. The system defined in claim 1 wherein said out-of-phase relationship between driven reciprocating pistons is between 90° and 120°.

5. The system defined in claim 1 wherein said thermal capacitor permits substantially unrestricted flow of air between said first and second chambers and does not substantially restrict communication between said chambers.

6. The system of claim 1 wherein said timing means includes cams for each of said first, second, third and fourth valves.

7. The system of claim 6 wherein said drive means includes a driven crankshaft and said cams are mounted on a camshaft and transmission means connect said crankshaft to said camshaft to cause said crankshaft to rotate at twice the speed of said camshaft.

8. The process of creating cool air and warm air from a source of air at ambient temperatures comprising the steps of:

compressing and heating a portion of said air and simultaneously passing said portion through a thermal capacitor in a first direction to remove and store a segment of its heat, expanding said portion permitting it to become cool and removing it to a place of use causing ambient air to pass through said capacitor in a direction opposite to said first direction, in sufficient amounts to remove the heat from said theremal capacitor.

9. The process of claim 8 wherein the expanding step is in an expanding chamber.

10. The Process of claim 9 wherein the said amount of ambient air flowing through said capacitor in a reverse direction is sufficient to evaporate and remove any water therein.

* * * * *